US011808232B2

(12) United States Patent
Hornby et al.

(10) Patent No.: US 11,808,232 B2
(45) Date of Patent: Nov. 7, 2023

(54) HIGH PRESSURE PORT FUEL INJECTION SYSTEM

(71) Applicant: Stanadyne LLC, Jacksonville, NC (US)

(72) Inventors: Michael Hornby, Emerald Isle, NC (US); Stephen Bugos, Poquoson, VA (US); Michael Kaput, New Bern, NC (US); Srinu Gunturu, Jacksonville, NC (US)

(73) Assignee: Stanadyne LLC, Jacksonville, NC (US)

( * ) Notice: Subject to any disclaimer, the term of this patent is extended or adjusted under 35 U.S.C. 154(b) by 0 days.

(21) Appl. No.: 18/163,640

(22) Filed: Feb. 2, 2023

(65) Prior Publication Data

US 2023/0243318 A1 Aug. 3, 2023

Related U.S. Application Data

(60) Provisional application No. 63/305,908, filed on Feb. 2, 2022.

(51) Int. Cl.
*F02D 41/40* (2006.01)
*F02D 41/38* (2006.01)

(52) U.S. Cl.
CPC ..... *F02D 41/402* (2013.01); *F02D 41/3845* (2013.01); *F02D 2200/021* (2013.01); *F02D 2200/0404* (2013.01); *F02D 2200/0602* (2013.01); *F02D 2200/101* (2013.01); *F02D 2250/31* (2013.01)

(58) Field of Classification Search
CPC ..... F02D 41/40; F02D 41/401; F02D 41/402; F02D 41/403; F02D 41/405
See application file for complete search history.

(56) References Cited

U.S. PATENT DOCUMENTS 6,363,903 B1 * 4/2002 Hayashi ..... F02D 13/0257 123/193.5
7,647,916 B2 1/2010 Leone et al.
9,175,599 B2 11/2015 Pursifull et al.
(Continued)

FOREIGN PATENT DOCUMENTS

JP H06159201 A 6/1994

OTHER PUBLICATIONS

PCT International Search Report and Written Opinion for International Application No. PCT/US2023/061855 filed on Feb. 2, 2023; dated May 3, 2023; 9 pgs.

*Primary Examiner* — John Kwon
(74) *Attorney, Agent, or Firm* — Alix, Yale & Ristas, LLP

(57) ABSTRACT

A port fuel injection system includes a fuel pump configured to produce a flow of pressurized liquid fuel at a pressure between 10 and 50 bar. A fuel rail is connected to receive the flow of pressurized liquid fuel from the fuel pump, the fuel rail. A plurality of fuel injectors, including one fuel injector positioned in the intake port of each engine cylinder upstream of the intake valve for the engine cylinder are connected to receive pressurized fuel from the fuel rail. An engine control unit (ECU) receives signals from sensors on the internal combustion engine and is programmed to actuate the fuel injectors to deliver fuel to each engine cylinder over a full range of engine operating conditions. A port fuel injection system with high pressure and fast acting fuel injectors improves fuel delivery and performance over the full range of engine operating conditions.

9 Claims, 4 Drawing Sheets

(56) References Cited

U.S. PATENT DOCUMENTS

| | | | | |
|---|---|---|---|---|
| 10,718,289 | B2 | 7/2020 | Surnilla et al. | |
| 10,731,590 | B2 * | 8/2020 | Inoue | F02P 5/045 |
| 10,767,593 | B2 * | 9/2020 | Inoue | F02P 5/1502 |
| 2007/0193559 | A1 | 8/2007 | Tokunda et al. | |
| 2012/0085322 | A1 | 4/2012 | Trzmiel | |
| 2012/0191326 | A1 | 7/2012 | Sukegawa et al. | |
| 2020/0232403 | A1 * | 7/2020 | Ottikkutti | F02D 41/1497 |

* cited by examiner

HIGH PRESSURE PORT FUEL INJECTION SYSTEM

BACKGROUND

The disclosure relates to a fuel injection system for delivering fuel to the cylinders of an internal combustion engine, and specifically to a port fuel injection system.

In a typical port fuel injection fuel delivery system, fuel is delivered to the port fuel injectors at low pressure of 5-6 bar generated by a gerotor type pump positioned in or near the fuel tank. Fuel at this low pressure is injected into the intake manifold for an engine cylinder when the intake valve for the cylinder is closed. Because the fuel passing through the port fuel injector is low pressure, atomization of the fuel is relatively poor and the port fuel injector typically produces relatively large size fuel droplets. The fuel is injected onto the back of the closed intake valve, which has been heated from combustion. The fuel vaporizes on the hot intake valve and mixes with air in the intake manifold while the intake valve is closed so when the intake valve opens, a well-mixed fuel air charge is drawn into the combustion chamber. Port fuel injectors typically perform best at low engine rpm and low load conditions. At high engine rpm and high load conditions, port fuel injectors tend to have poor performance because there is insufficient time for fuel vaporization and low fuel pressure prevents delivery of adequate quantities of fuel to meet demand. For this reason, some prior art fuel delivery systems include both port fuel injectors and direct fuel injectors arranged to deliver finely atomized fuel at high pressure directly into the combustion chamber. In such a system, the direct injectors require fuel at very high pressures above 300 bar, which require a high-pressure pump, fuel lines and high-pressure rail. This is a costly fuel system configuration and the direct injectors may only be used under high rpm/high load conditions that represent a small proportion of engine operation. The high-pressure fuel pump also represents a significant parasitic load on the engine, further reducing overall efficiency.

There is a need in the art for an improved port fuel injection system that can provide fuel delivery that results in acceptable emissions and performance at both low load/low rpm and high load/high rpm engine operating conditions. Such as system can reduce overall fuel delivery system cost by eliminating the need for the direct injectors and associated fuel lines and high-pressure pump.

There is a need in the art for an improved port fuel injection system that can be used with an existing internal combustion engine configuration while improving performance and reducing emissions when compared to existing port fuel injection systems.

SUMMARY OF THE DISCLOSURE

A port fuel injection system for an internal combustion engine is disclosed. The internal combustion engine may have any number of engine cylinders, each engine cylinder having an intake port, at least one intake valve, and a combustion chamber. The disclosed port fuel injection system includes a fuel reservoir such as a fuel tank containing a supply of liquid fuel. A fuel pump is connected to the fuel reservoir and arranged to produce a flow of pressurized liquid fuel from the fuel reservoir at a pressure between 10 and 50 bar. A fuel rail is connected to receive the flow of pressurized liquid fuel from the fuel pump, the fuel rail including a pressure sensor producing a signal corresponding to the fuel pressure in the fuel rail. A plurality of fuel injectors, including one fuel injector positioned in the intake port of each engine cylinder upstream of the intake valve for the engine cylinder are connected to receive pressurized fuel from the fuel rail. An engine control unit (ECU) receives signals from sensors on the internal combustion engine corresponding to engine temperature, engine rotational speed, crank shaft rotational position, engine throttle position, and fuel rail pressure. The ECU is programmed to actuate the fuel injectors to deliver fuel to each engine cylinder over a full range of engine operating conditions by controlling each fuel injector to inject fuel into the intake port at a first or second time of injection, a first time of fuel injection for each engine cylinder corresponding to a time when the intake valve is closed for a first range of engine operating conditions and a second time of fuel injection corresponding to a time when the intake valve is open for a second range of engine operating conditions.

The disclosure also includes a method for supplying liquid fuel to an internal combustion engine exclusively by a port fuel injection system. The internal combustion engine has a plurality of engine cylinders, each engine cylinder having an intake port, at least one intake valve, and a combustion chamber. The port fuel injection system includes a fuel reservoir such as a fuel tank containing a supply of liquid fuel and a low pressure fuel supply pump generating a flow of fuel from the fuel tank to a fuel pump that produces a flow of pressurized liquid fuel at a pressure between 10 and 50 bar. The fuel pump includes an inlet control valve arranged to regulate the quantity of pressurized fuel produced per unit time by the fuel pump. A fuel rail is connected to receive the flow of pressurized liquid fuel and includes a pressure sensor producing a signal corresponding to the fuel pressure in the fuel rail. A plurality of fuel injectors, consisting of one fuel injector positioned in the intake port of each engine cylinder upstream of the intake valve for the engine cylinder are connected to receive pressurized fuel from the fuel rail. An engine control unit (ECU) receives signals from sensors on the internal combustion engine corresponding to engine temperature, engine rotational speed, crank shaft rotational position, engine throttle position, and fuel rail pressure. The method includes delivering fuel to the intake of each engine cylinder under the control of the ECU over a full range of engine operating conditions by controlling each fuel injector to inject fuel into the intake port at a first or second time of injection, a first time of fuel injection for each engine cylinder corresponding to a time when the intake valve is closed for a first range of engine operating conditions and a second time of fuel injection corresponding to a time when the intake valve is open for a second range of engine operating conditions. The method also including regulating fuel pressure in the fuel rail over a range of between 10 bar and 50 bar by coordinating the quantity of pressurized fuel produced by the fuel pump with engine operating conditions.

DETAILED DESCRIPTION

Figure 1:
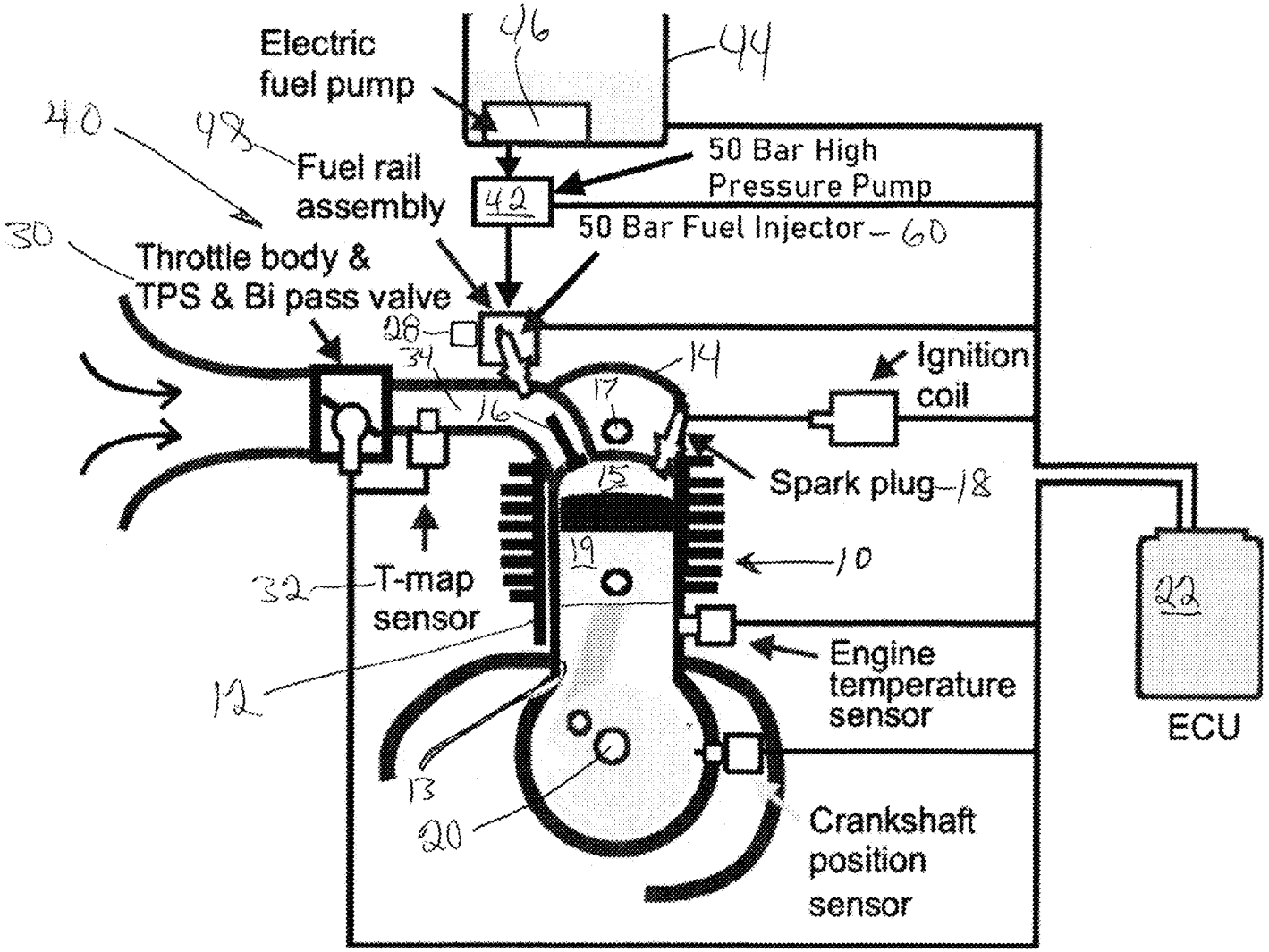
FIG. 1 is a schematic representation of one engine cylinder of an internal combustion engine and a high-pressure port fuel injection system according to aspects of the disclosure.

FIG. 1 illustrates an internal combustion engine 10 showing one engine cylinder 12 and an embodiment of the disclosed high-pressure port fuel injection system 40. The internal combustion engine 10 may have any number of cylinders 12, all of which are substantially identical to the engine cylinder 12 shown in FIG. 1. Each engine cylinder 12 has a cylindrical bore 13, an upper portion of which meets a cylinder head 14 to define a combustion chamber 15 with at least one intake valve 16, at least one exhaust valve 17 and a spark plug 18. A piston 19 reciprocates in the cylindrical bore 13 and is connected to a crankshaft 20 that combines force from all the pistons 19 to produce torque that is used to perform work such as to provide drive force to wheels in a motor vehicle. Flow of air and fuel to be combusted through each engine cylinder 12 is controlled by opening and closing the intake and exhaust valves 16, 17 in coordination with movement of the pistons 19 in a manner known in the art. The illustrated internal combustion engine 10 is a four-cycle engine where each piston 19 moves two times from the top of its travel (TDC) in the engine cylinder 12 to the bottom its travel (BDC) in the engine cylinder 12 and two times from the bottom of its travel (BDC) in the engine cylinder 12 to the top of its travel (TDC) in the engine cylinder 12 for each complete combustion cycle of an engine cylinder 12. A first "stroke" from TDC to BDC is coordinated with opening of the intake valve 16 while the exhaust valve 17 remains closed to draw in a fresh charge of air mixed with fuel and is called the intake stroke. A second stroke of the piston 19 from BDC to TDC is coordinated with closing of the intake valve 16 while the exhaust valve 17 remains closed to compress the charge of air and fuel and is called the compression stroke. When the charge of air and fuel is compressed and the piston 19 is at TDC, the charge is ignited by a spark at the spark plug 18. Combustion of the fuel-air mixture expands the gases in the combustion chamber 15 and drives the piston 19 from TDC to BDC in what is called the power stroke. Both the intake and exhaust valves 16, 17 are typically closed during the compression and power strokes. Finally, the exhaust valve 17 is opened as the piston moves from BDC to TDC to push out the combusted fuel-air mixture and the process begins again with closure of the exhaust valve 17 and opening of the intake valve 16 during an intake stroke.

The intake and exhaust valves 16, 17 are opened and closed by a cam (not shown) that is coupled to the crank shaft 20 by gears, a belt or a chain, (not shown) so opening and closing of the valves 16, 17 for each engine cylinder 12 is coordinated with movement of the piston 19 in that engine cylinder. An engine control unit (ECU) 22 is a programmable control device that receives inputs from sensors on the engine 10 to identify the position of the crankshaft 20 (which dictates the position of each piston 19 in its engine cylinder 12) and the crankshaft rotational speed (crankshaft position sensor 24), the temperature of the engine (engine temperature sensor 26, the pressure of fuel in the fuel rail assembly (fuel pressure sensor 28), the position of the throttle (throttle position sensor TPS 30) and the pressure in the intake manifold (MAP sensor 32). Other sensors may provide inputs to the ECU 22 as is known in the art. The ECU 22 uses these inputs to calculate the quantity of fuel delivered to each engine cylinder 12 and to coordinate the time of fuel delivery to each engine cylinder 12 with the movement of the piston 19 in that cylinder and opening of the intake valve 16. In a port fuel injected engine 10, fuel is delivered to the intake port 34 of each engine cylinder 12 either just before or during the intake stroke of the piston 19. Fuel delivered just before the intake stroke is injected into the intake port 34 for an engine cylinder 12 while the intake valve 16 is closed. When the engine 10 is hot, fuel droplets hit the hot intake valve and are vaporized, which improves mixing of the fuel with the incoming air. Well-mixed air and fuel are cleanly combusted. When the engine 10 is cold, such as during startup, fuel injected into the intake port 34 can remain in a liquid state, which can lead to poor mixing with incoming air and result in emissions of unburned fuel. As will be discussed in greater detail below, the disclosed high-pressure port fuel injection system 40 breaks the liquid fuel up into small droplets of between 15 and 20 Sauter Mean Diameter (SMD) which are better evaporated and mixed with air than larger droplets produced by prior art low-pressure port fuel injection systems. During engine operation at high RPM and high loads, the ECU 22 controls the disclosed port fuel injectors 60 to inject fuel timed to arrive at the intake valve 16 when the intake valve is open. The disclosed high-pressure port fuel injection system 40 improves engine performance and emissions by injecting fuel in smaller droplets and at a higher velocity than was possible with prior art low-pressure port injection systems, so fuel and air are well mixed during the intake stoke and cleanly combusted. The quantity of fuel that can be delivered to an engine cylinder 12 is also increased due to the increase fuel pressure which increases the rate of fuel passing through the injector nozzle.

Figure 2:
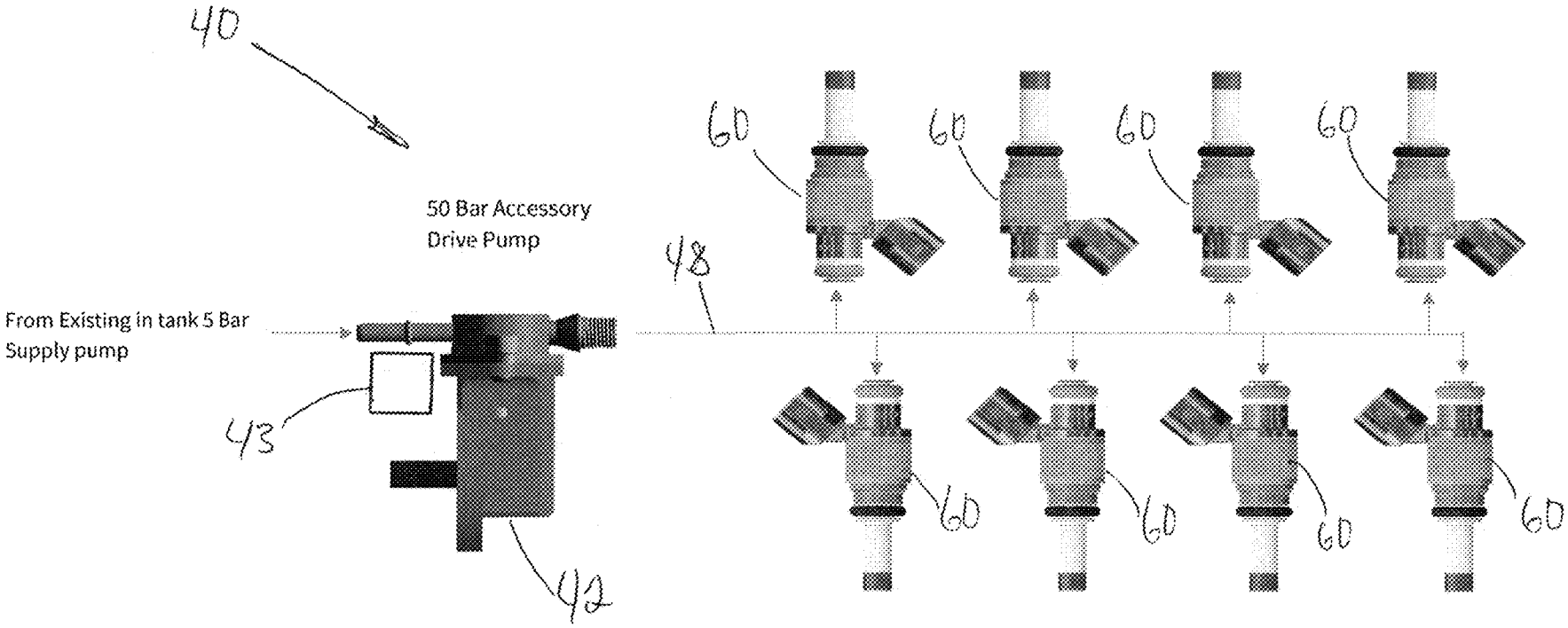
FIG. 2 is a schematic representation of a high pressure port fuel injection system according to aspects of the disclosure.

One example of a port fuel injection system 40 according to the disclosure is schematically illustrated in FIG. 2. A piston type high-pressure fuel pump 42 is supplied with fuel from a fuel tank 44 by a low-pressure supply pump 46 positioned the fuel tank as is known in the art. The low-pressure supply pump 46 delivers fuel to the inlet of the high-pressure pump 42 at approximately 5-6 bar. The high-pressure fuel pump 42 pressurizes the fuel to a range of pressures between 10 bar-50 bar and delivers the pressurized fuel to a fuel rail 48 connected to port fuel injectors 60. The high-pressure pump 42 includes an inlet control valve 43 that controls the quantity of fuel pressurized with each pumping stroke of the piston, which allows pressure in the fuel rail 48 to vary between 10 bar and 50 bar depending on engine operating conditions. The structure and function of different inlet control valves 43 are well-understood by those skilled in the art and will not be described in detail here. The disclosed port fuel injection system 40 is not limited to any particular type or functionality of an inlet control valve 43. At low load/low RPM operating conditions when the engine 10 is hot, a relatively low fuel pressure may be sufficient, while at high load/high RPM operating conditions or when the engine 10 is cold, high fuel pressure is required for acceptable performance and emissions. The ECU 22 will coordinate operation of the inlet control valve 43 with engine operating conditions, improving the overall efficiency of the fuel delivery system. As is known in the art, the pressure in the fuel rail 48 will take time to respond to changes in the quantity of fuel pressurized by the high-pressure fuel pump 42. Pressure in the fuel rail 48 will fall as the high-pressure fuel pump 42 produces less pressurized fuel than is consumed by the fuel injectors 60. Pressure in the fuel rail 48 will rise as the high-pressure fuel pump 42 produces more pressurized fuel than is consumed at the fuel injectors 60. Changes in fuel pressure in the fuel rail 48 will occur over a time period corresponding to several pumping cycles or fuel injection cycles as engine operating conditions change. Matching fuel pressurization with fuel demand minimizes the parasitic load of the high-pressure fuel pump 42 on the internal combustion engine 10 and improves overall engine efficiency. The pumping capacity of the high-pressure fuel pump 42 will be matched with peak fuel demand expected for the internal combustion engine, and the inlet control valve 43 can be used to modulate delivery of pressurized fuel under control of the ECU 22.

The high-pressure fuel pump 42 may be driven by any known means (not shown), such as an engine shaft, accessory drive belt, or dedicated electric motor. Because the pump 42 generates a relatively modest 50 bar maximum pressure, the maximum torque required to drive the high-pressure pump 42 is correspondingly modest. This is in contrast to the high torque required to drive a high-pressure pump for a direct injection (DI) system that operates at 300 bar or above. The parasitic load on the engine 10 imposed by the high-pressure pump 42 according to the disclosure is a fraction of that required to drive a very high-pressure pump in a typical direct injection system. Further, the parasitic load is reduced when fuel delivery from the high-pressure pump 42 is matched to engine operating conditions by the ECU 22.

Figure 4:
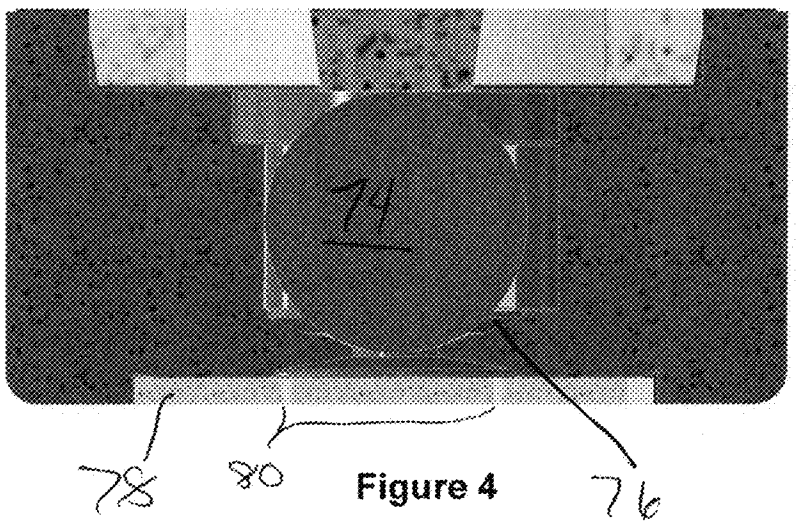
FIG. 4 is an enlarged sectional view through the nozzle end of the fuel injector of FIG. 3.
Figure 3:
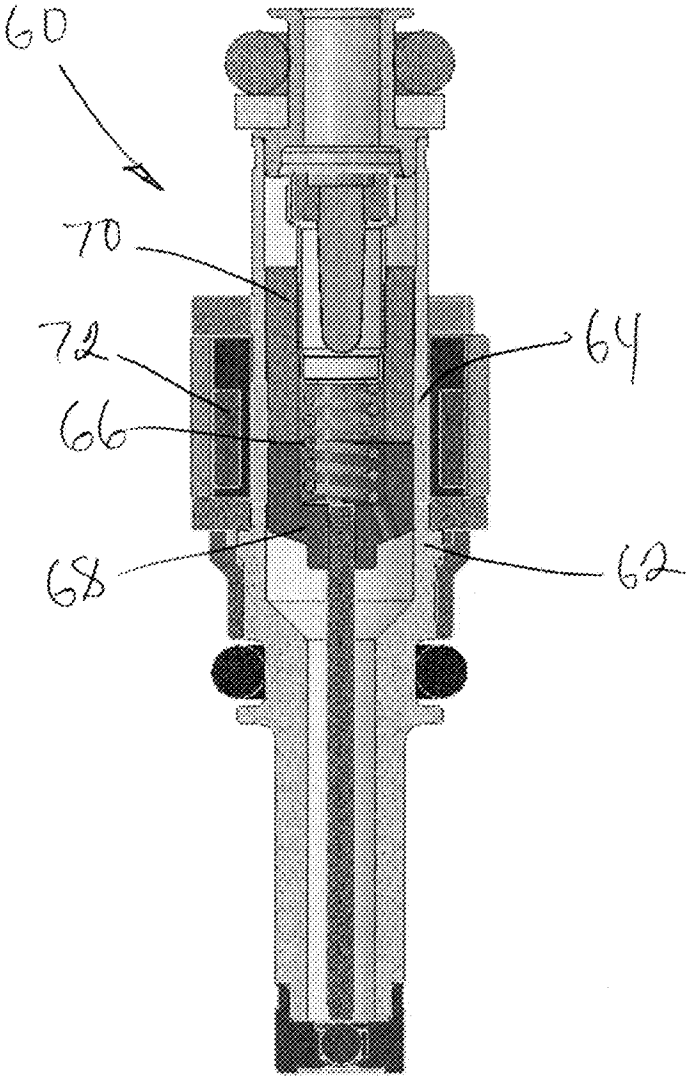
FIG. 3 is a longitudinal sectional view through a fuel injector for use with the disclosed high pressure port fuel injection system.
Figure 5:
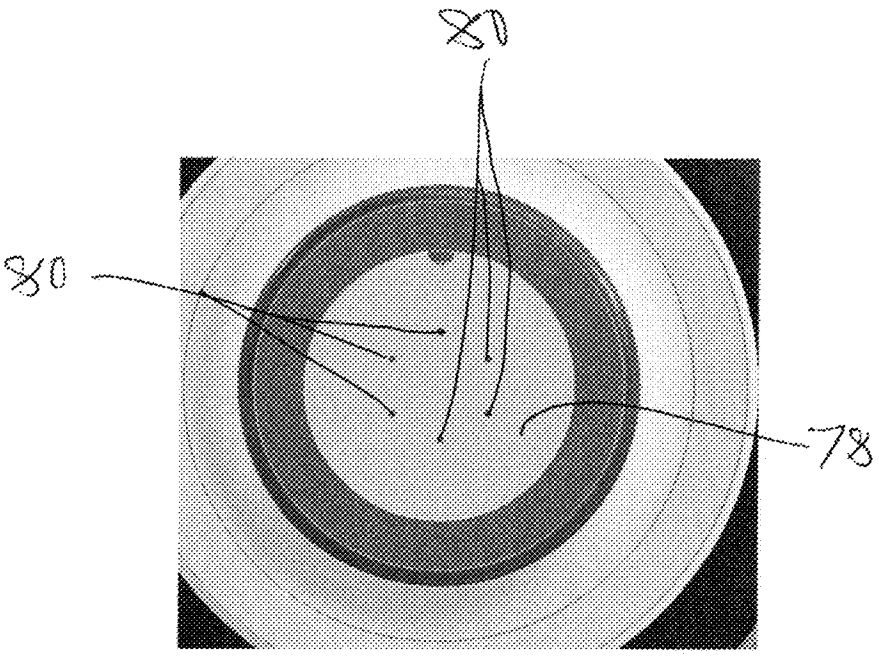
FIG. 5 is an enlarged bottom view of the nozzle end of the fuel injector of FIG. 3.

As shown in FIG. 1, each port fuel injector 60 is positioned in an air intake passage 34 for an engine cylinder upstream of the intake valve(s) 16. FIG. 2 illustrates an eight port fuel injector system suitable for an eight cylinder engine, but any number of engine cylinders and port fuel injectors 60 may be used. FIGS. 3-5 illustrate a representative port fuel injector 60 compatible with the disclosed high-pressure port fuel injection system 40. The port fuel injectors 60 are configured to be fast acting, solenoid actuated injectors similar to fuel injectors used in DI fuel delivery systems that inject fuel directly into an engine cylinder. The disclosed fuel injectors 60 have an efficient magnetic circuit which allow the injectors to open quickly and be held open for extended periods while consuming relatively low power. As shown in FIG. 3, the injector body 62 includes a non-magnetic region 64 surrounding the gap 66 between an armature 68 and pole 70 of the solenoid used to open the fuel injector 60. Magnetic flux generated when power is applied to the solenoid coil 72 22 by the ECU is directed through the pole 70 and armature 68 by the non-magnetic portion 64 of the injector body 62, increasing the efficiency of the solenoid. Efficiency of the solenoid means the force generated on the armature 68 for a given electrical power applied to the solenoid coil 72. A more efficient solenoid allows the injector 60 to have a stronger closing force compatible with high fuel pressures, without increased power consumption or requiring a larger coil 72. This injector design enables operation with high fuel pressures according to aspects of the disclosure. The disclosed fuel injectors 60 have a fast response time, opening and closing in less than 0.8 mS, which enhances the accuracy of injection events and enables flexibility in fuel delivery. FIGS. 4 and 5 are enlarged views showing a representative injector valve member 74, valve seat 76 and injector nozzle plate 78 defining injector orifices 80. The disclosed port fuel injection system 40 is not limited to the disclosed spherical valve member 74 and complementary valve seat 76, or the illustrated hexagonal arrangement of six laser drilled injection orifices 80. As is known in the art, the injection orifices 80 can be produced with a cross-sectional shape and orientation that generates a desired size, pattern and direction of fuel droplets. According to aspects of the disclosure, the fuel droplet size, velocity and quantity of fuel emitted from the fuel injectors 60 will vary in a predictable way depending upon the fuel pressure in the fuel rail 48. The disclosed fuel injectors 60 are configured for use with an existing intake manifold without modification. This feature of the disclosed port fuel injection system 40 reduces the cost of modifying the internal combustion engine 10 to use the disclosed port fuel injection system 40.

According to aspects of the disclosure, boosting the pressure of fuel delivered to the port fuel injectors 60 improves atomization of fuel injected into the intake passage 34 for each engine cylinder 12, improving the fuel air mixture entering the combustion chamber 15 under all engine operating conditions. Port fuel injectors 60 according to the disclosure may have a plurality of laser drilled injection orifices 80 from which fuel is sprayed under pressure when the injector 60 is opened by actuation of the solenoid by the ECU 22. The high-pressure port fuel injectors 60 according to the disclosure produce fuel in droplets of about 10-15 Sauter Mean Diameter (SMD) at maximum fuel pressure of 50 bar, while port fuel injectors operated at supply pressure (less than 10 bar, typically 5-6 bar) tend to produce much larger droplets, on the order of 70 SMD. The disclosed high pressure port fuel injectors 60 are compact, allowing them to be positioned in the intake manifold with little or no changes to the manifold or other engine components. The fine atomization of liquid fuel made possible by increased fuel pressure produce better mixing of fuel with intake air delivered to each engine cylinder 12. This feature of the disclosed port fuel injection system 40 will improve cold starting and reduce emissions of the internal combustion engine 10 when operated at high load/high rpm conditions. Performance of existing low pressure port fuel injection systems has been poor in each of these engine operating conditions, characterized by hard starting in cold conditions and poor emissions control at high load/high rpm conditions. In each case, enhanced mixing of fuel with intake air is made possible by fine atomization of liquid fuel provides improved performance. At high load/high RPM engine operating conditions, the disclosed high-pressure port fuel injection system 40 can inject more fuel per unit time to meet fuel demand.

According to aspects of the disclosure, the disclosed port fuel injectors 60 may be opened to inject fuel into the intake when the intake valve 16 is closed during low rpm/low load engine operating conditions. Under low RPM/low load conditions, fuel delivery is improved due to the smaller fuel droplet size generated by the disclosed high-pressure port fuel injectors 60 operated at fuel pressure up to 50 bar. Improved performance may be particularly pronounced under cold starting conditions where fuel vaporization and air mixing is improved in the absence of a hot intake valve 16. Fuel control is also improved by smaller fuel droplets improved evaporation in contrast to prior art large droplets wetting adjacent surfaces or collecting in the intake 34. The high-pressure port fuel injection system 40 can also be operated to deliver high quantities of fuel in a well-mixed charge through an open intake valve 16 under high rpm/high load engine operating conditions. High fuel pressure also increases the velocity of fuel droplets toward the intake valve 16, facilitating delivery of more fuel per unit time. Open valve injection event timing provides the charge cooling benefits of direct injection, without positioning the injector in the combustion chamber 15 and exposing the injector tip to carbon fouling. Fuel passing the intake valve 16 cleans the intake valve, reducing deposits that may form on intake valves in direct injected engines.

The disclosed high-pressure port fuel injection system 40 improves over the prior art low-pressure port fuel injection over the entire range of engine operating conditions and provides many of the benefits of direct fuel injection without the cost and complexity of a direct injection system.

What is claimed is:

1. A port fuel injection system for an internal combustion engine having a plurality of engine cylinders, each engine cylinder having an intake port, at least one intake valve, and a combustion chamber, said port fuel injection system comprising:

a fuel reservoir containing a supply of liquid fuel;

a fuel pump connected to the fuel reservoir and arranged to produce a flow of pressurized liquid fuel from the fuel reservoir at a pressure between 10 and 50 bar;

a fuel rail connected to receive said flow of pressurized liquid fuel, said fuel rail including a pressure sensor producing a signal corresponding to the fuel pressure in said fuel rail;

a plurality of fuel injectors, including one fuel injector positioned in the intake port of each engine cylinder upstream of the intake valve for the engine cylinder; and an engine control unit (ECU) that receives signals from sensors on the internal combustion engine corresponding to engine temperature, engine rotational speed, crank shaft rotational position, engine throttle position, and fuel rail pressure, wherein said ECU is programmed to deliver fuel through each fuel injector to each engine cylinder over a full range of engine operating conditions by controlling each fuel injector to inject fuel into the intake port at a first or second time of injection, a first time of fuel injection for each engine cylinder corresponding to a time when the intake valve is closed for a first range of engine operating conditions and a second time of fuel injection corresponding to a time when the intake valve is open for a second range of engine operating conditions.

2. The port fuel injection system of claim 1, wherein said fuel injectors have an opening time and closing time less than 800 μS.

3. The port fuel injection system of claim 1, wherein said fuel injectors produce fuel droplets smaller than 20 SMD.

4. The port fuel injection system of claim 1, wherein said ECU controls said fuel injectors to produce multiple fuel injection events for each combustion event in an engine combustion chamber.

5. The port fuel injection system of claim 1, wherein each engine cylinder does not include a fuel injector to directly inject fuel into the combustion chamber.

6. The port fuel injection system of claim 1, wherein said fuel pump includes an inlet control valve regulating the quantity of fuel pressurized per unit time by the fuel pump.

7. The port fuel injection system of claim 1, wherein the ECU operates the inlet control valve to regulate fuel pressure in said fuel rail between 10 bar and 50 bar according to engine operating conditions.

8. A method for supplying liquid fuel to an internal combustion engine exclusively by a port fuel injection system, said internal combustion engine having a plurality of engine cylinders, each engine cylinder having an intake port, at least one intake valve, and a combustion chamber, said port fuel injection system comprising:

a fuel reservoir containing a supply of liquid fuel;

a fuel pump connected to the fuel reservoir and arranged to produce a flow of pressurized liquid fuel from the fuel reservoir at a pressure between 10 and 50 bar, said fuel pump including an inlet control valve arranged to regulate the quantity of pressurized fuel produced per unit time by the fuel pump;

a fuel rail connected to receive said flow of pressurized liquid fuel, said fuel rail including a pressure sensor producing a signal corresponding to the fuel pressure in said fuel rail;

a plurality of fuel injectors, consisting of one fuel injector positioned in the intake port of each engine cylinder upstream of the intake valve for the engine cylinder; and an engine control unit (ECU) that receives signals from sensors on the internal combustion engine corresponding to engine temperature, engine rotational speed, crank shaft rotational position, engine throttle position, and fuel rail pressure, wherein said method comprises:

delivering fuel to the intake of each engine cylinder under the control of the ECU over a full range of engine operating conditions by controlling each fuel injector to inject fuel into the intake port at a first or second time of injection, a first time of fuel injection for each engine cylinder corresponding to a time when the intake valve is closed for a first range of engine operating conditions and a second time of fuel injection corresponding to a time when the intake valve is open for a second range of engine operating conditions.

9. The method of claim 8, comprising:

regulating fuel pressure in the fuel rail over a range of between 10 bar and 50 bar by coordinating the quantity of pressurized fuel produced by the fuel pump with engine operating conditions.

* * * * *